US006634718B2

(12) United States Patent
Matsuo

(10) Patent No.: US 6,634,718 B2
(45) Date of Patent: Oct. 21, 2003

(54) CONSTRUCTION OF SEAT CUSHION

(75) Inventor: Takashi Matsuo, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/955,453

(22) Filed: Sep. 18, 2001

(65) Prior Publication Data

US 2002/0038971 A1 Apr. 4, 2002

(30) Foreign Application Priority Data

Oct. 2, 2000 (JP) ..... 2000-301565

(51) Int. Cl.[7] ..... A47C 7/24
(52) U.S. Cl. ..... 297/452.18; 297/452.59
(58) Field of Search ..... 297/452.58, 452.59, 297/452.48, 452.52, 452.18, 218.1, 452.55; 5/653, 740, 730

(56) References Cited

U.S. PATENT DOCUMENTS 4,365,840 A * 12/1982 Kehl et al. ..... 297/440.2
4,861,104 A * 8/1989 Malak ..... 297/218.3
5,288,134 A * 2/1994 Hewko et al. ..... 297/344.1
5,931,538 A * 8/1999 Cayet et al. ..... 297/452.59
6,027,171 A * 2/2000 Partington et al. ..... 297/452.18

FOREIGN PATENT DOCUMENTS

JP 06190159 A * 7/1994 ..... B68G/7/05

* cited by examiner

*Primary Examiner*—Peter M. Cuomo
*Assistant Examiner*—Stephen D'Adamo
(74) *Attorney, Agent, or Firm*—Alston & Bird LLP

(57) ABSTRACT

The present invention provides a construction of a seat cushion formed by mounting a cushion pad on a cushion frame formed into a rectangular shape and by covering the cushion pad with a skin, wherein a recess is provided at the rear end of the cushion frame, and on the other hand, an extension extending downward is integrally formed at the rear end of the cushion pad, by which the extension is fitted in the recess in the cushion frame.

2 Claims, 4 Drawing Sheets

CONSTRUCTION OF SEAT CUSHION

BACKGROUND OF THE INVENTION AND RELATED ART STATEMENT

1. Field of the Invention

The present invention relates to a construction of a seat cushion for an automobile seat. More particularly, it relates to a construction of a seat cushion for a seat disposed in the front, of seats disposed in the front and rear in a cabin.

2. Description of Related Art

Conventionally, the rear side of a seat cushion for an automobile seat is covered with a back cover fabricated by molding a soft material such as fabric sheet into a three-dimensional shape. This back cover, which is provided to prevent the seat cushion, shoes, and the like from being damaged if the shoes of a passenger seated on the rear seat hit the seat cushion, is fixed to the seat cushion by using clips or the like.

A problem with the above-described conventional seat cushion is that since a separate back cover is needed to cover the rear side of the seat cushion, not only the number of parts and the manpower for fabrication increases, but also assembling work is troublesome, which leads to a high cost and difficulty in increasing work efficiency.

OBJECT AND SUMMARY OF THE INVENTION

The present invention has been made in view of the above situation, and accordingly an object thereof is to provide a construction of a seat cushion, in which a load applied to the shoes and the like of a passenger seated on a seat in the rear can be moderated, and the assembling work can be made easy, without an increase in the number of parts and the manpower for fabrication and work.

To solve the problem with the above-described related art, the present invention provides a construction of a seat cushion formed by mounting a cushion pad on a cushion frame formed into a rectangular shape and by covering the cushion pad with a skin, wherein a recess is provided at the rear end of the cushion frame, and on the other hand, an extension extending downward is integrally formed at the rear end of the cushion pad, by which the extension is fitted in the recess in the cushion frame.

As described above, according to the construction of a seat cushion in accordance with the present invention, a seat cushion is formed by mounting a cushion pad on a cushion frame formed into a rectangular shape and by covering the cushion pad with a skin, and is arranged so that a recess is provided at the rear end of the cushion frame, and on the other hand, an extension extending downward is integrally formed at the rear end of the cushion pad, by which the extension is fitted in the recess in the cushion frame. Therefore, a load applied when the shoes and the like of a passenger seated on a seat in the rear come into contact with the seat cushion can be moderated, and the assembling work can be made easy, without an increase in the number of parts and the manpower for fabrication and work.

Also, in the construction of a seat cushion in accordance with the present invention, if the rear end of a side frame constituting a side portion of the cushion frame projects outward and rearward from the recess without being covered with the cushion pad, at the time of covering, the deformation of the rear end corner portions of the seat cushion is prevented even if tension is applied to the skin, so that the dimensional accuracy can be maintained.

Further, in the construction of a seat cushion in accordance with the present invention, if the recess in the cushion frame and the rear end of the side frame are connected by an inclined face spreading on the outside gradually toward the rear, or if the recess in the cushion frame is formed by a curved face spreading on the outside gradually toward the rear so that each end of the curved face is connected to the rear end of the side frame, an impact load applied from the side of the seat cushion can be distributed to the side frame effectively, by which the concentration of stresses can be prevented.

DETAILED DESCRIPTION OF PREFERRED EMBODIMENTS

An embodiment of the present invention will now be described in detail with reference to the accompanying drawings.

Figure 1:
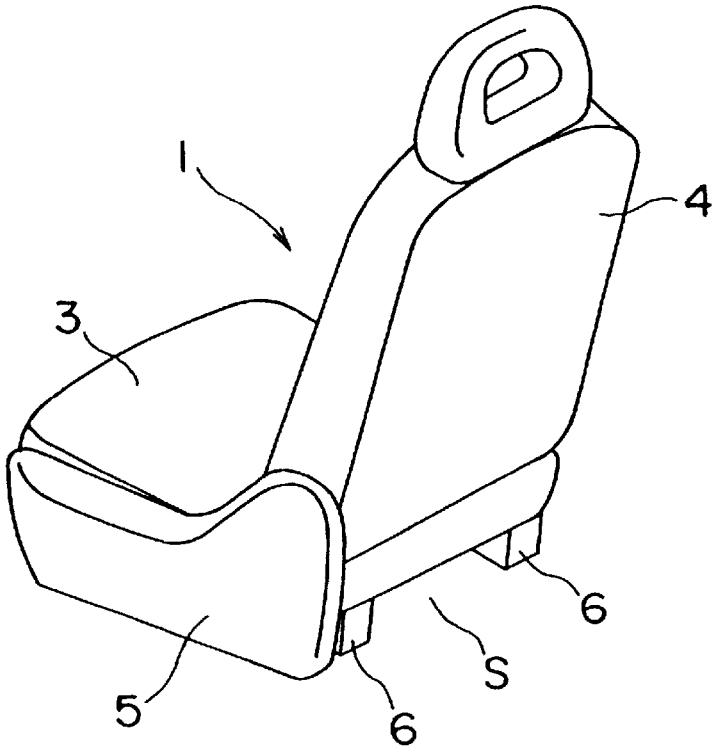
FIG. 1 is a perspective view showing the whole of an automobile seat to which a construction of a seat cushion in accordance with an embodiment of the present invention is applied.
Figure 2:
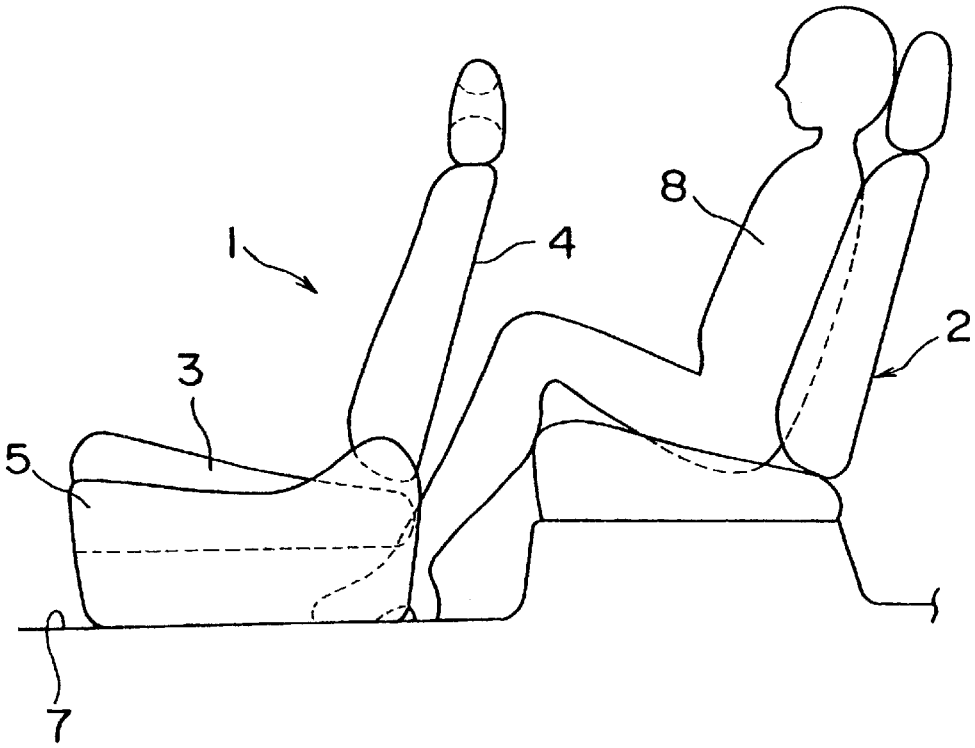
FIG. 2 is a side view showing a positional relationship between a seat in the front shown in FIG. 1 and a foot of a passenger seated on a seat in the rear.

FIGS. 1 to 6 show an embodiment of a construction of a seat cushion in accordance with the present invention. As shown in FIGS. 1 and 2, in a cabin of an automobile, a plurality of seats 1 and 2 are arranged with a clearance being provided in the longitudinal direction of a vehicle. A seat 1 in the front (front seat) consists mainly of a seat cushion 3 on which a passenger sits and a seat back 4 for supporting the back of the sitting passenger. The seat back 4 is supported via a reclining device 5 so that the angle thereof can be adjusted with respect to the seat cushion 3. Furthermore, the seat 1 in the front is installed so that the whole thereof can be moved in the longitudinal direction with respect to a vehicle body floor 7 along a set of slide rails 6 provided at both sides, right and left, under the seat cushion 3.

When the plural seats 1 and 2 are arranged in the longitudinal direction of the vehicle, as shown in FIG. 2, the feet of a passenger 8 seated on a seat 2 in the rear (rear seat) get into a space S between the slide rails 6 provided at both sides under the seat cushion 3 located in the front, so that the rear end of the seat cushion 3 is liable to come into contact with the shins of the passenger 8. When the seat 2 is arranged in the rear of the vehicle, therefore, the rear end of the seat cushion 3 is preferably formed of a material as soft as possible so that there arises no problem even if the leg of the passenger 8 comes into contact with the rear end of the seat cushion 3.

Thereupon, for the seat cushion 3 in accordance with the embodiment of the present invention, as shown in FIGS. 3 to 6, the rear end side of a cushion frame 9 is recessed and a part of a cushion pad 10 is extended, and the extended portion is disposed in the recessed portion of the cushion frame 9, so that the cushion pad 10 with a sufficient thickness is interposed between the shins of the passenger 8 and the cushion frame 9.

For this purpose, the seat cushion 3 is formed by mounting the cushion pad 10 on the cushion frame 9 formed into a rectangular shape, by putting a seat trim (skin material) 11 sewed to the shape of the seat cushion 3 on the cushion pad 10, and by fixing the longitudinal and transverse end portions of the seat trim 11 on the lower face of the cushion frame 9 with fixtures 12 such as C rings and J traps.

Specifically, the cushion frame 9, which is formed by combining four square members having a square shape in cross section into a frame form and by joining them to each other, is made up of a front frame 13, side frames 14, and a rear frame 15. The square member used may be a square pipe, or may be formed by combining the opening portions of members, each of which has been pressed into a U shape, into a square shape in cross section.

Figure 3:
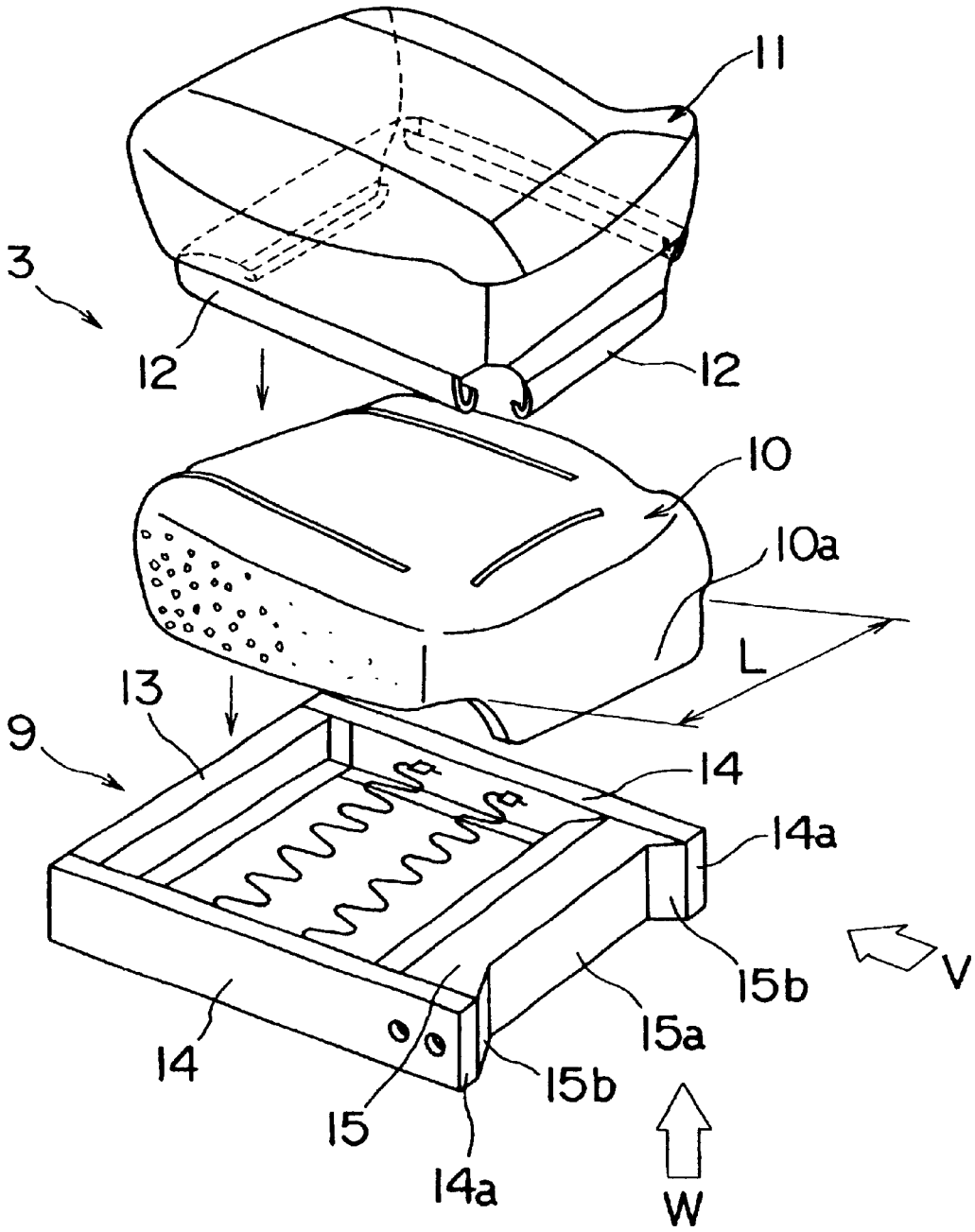
FIG. 3 is an exploded perspective view showing a construction of a seat cushion in accordance with an embodiment of the present invention.
Figure 6:
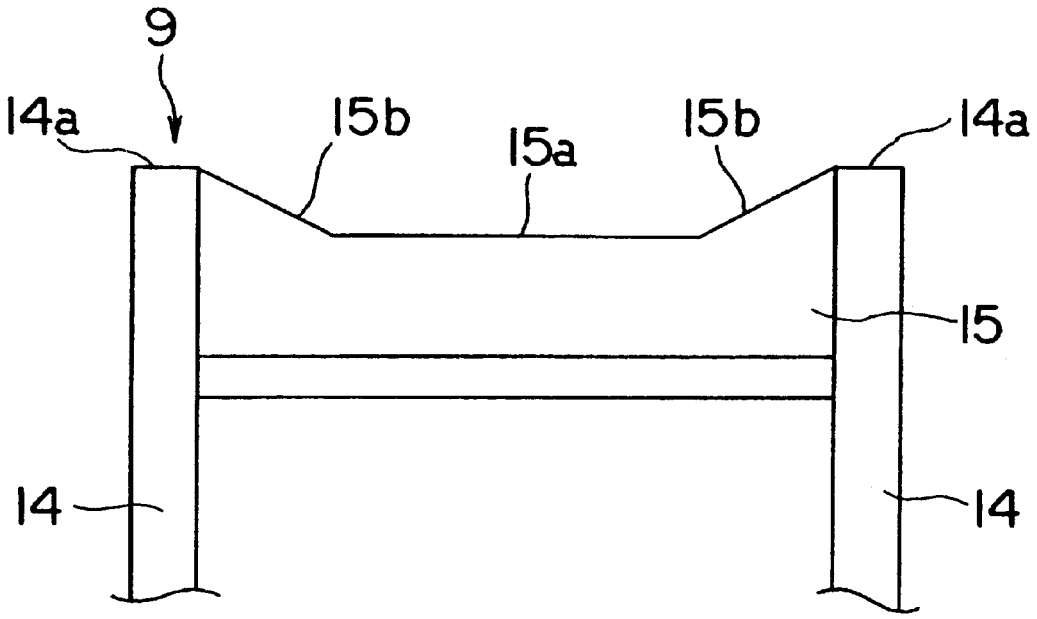
FIG. 6 is a plan view of a cushion frame viewed in the direction of the arrow W of FIG. 3.

In the rear face of the rear frame 15 disposed at the rear end of the cushion frame 9, a recess 15*a* that is made toward the front frame 13 is provided as shown in FIGS. 3 and 6. At both sides of the recess 15*a*, there are provided inclined faces 15*b* of a tapered shape spreading on the outside gradually toward the rear. The inclined face 15*b* connects with a rear end 14*a* of the side frame 14 constituting a side portion of the cushion frame 9. Therefore, the recess 15*a* in the rear frame 15 and the rear end 14*a* of the side frame 14 are connected by the inclined face 15*b*.

Figure 4:
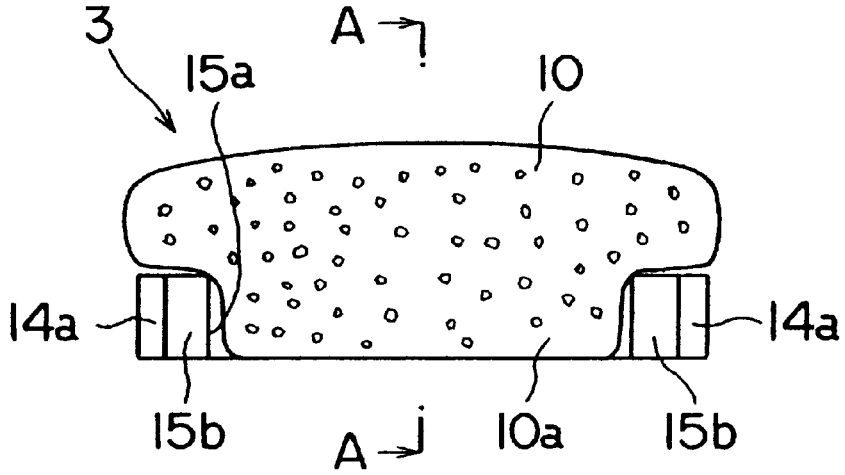
FIG. 4 is a front view of a cushion pad and a cushion frame viewed in the direction of the arrow V of FIG. 3.
Figure 5:
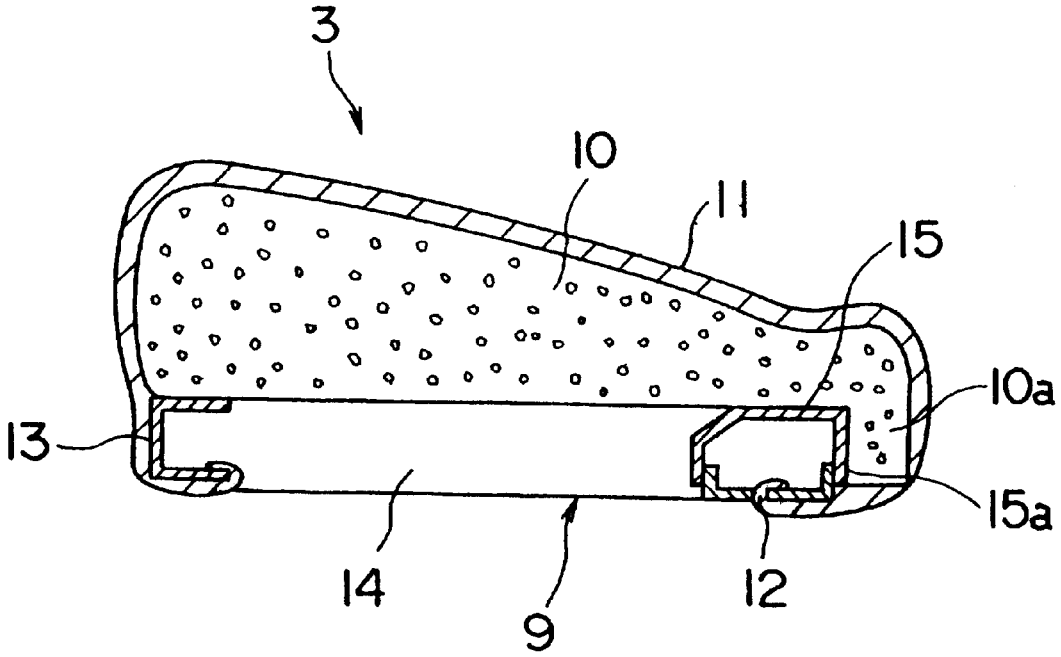
FIG. 5 is a sectional view taken along the line A—A of FIG. 4.

On the other hand, the cushion pad 10 is an integrally molded product having a shape and a size corresponding to the seat cushion 3, which is made of integrally expanded urethane. At the rear end of the cushion pad 10, an extension 10*a* extending downward is formed integrally as shown in FIGS. 3 to 5. The width dimension L of the extension 10*a* is set so as to be smaller than the width dimension of the recess 15*a* in the rear frame 15 constituting a rear portion of the cushion frame 9 so that the extension 10*a* can be fitted and contained in the recess 15*a*.

According to the construction of the seat cushion 3 in accordance with the embodiment of the present invention, the recess 15*a* is provided in the rear face of the rear frame 15 disposed at the rear end of the cushion frame 9, and the extension 10*a* is formed integrally at the rear end of the cushion pad 10. Therefore, when the cushion pad 10 is mounted on the cushion frame 9, the extension 10*a* of the cushion pad 10 is fitted in the recess 15*a* of the rear frame 15, so that the rear end of the cushion frame 9 is covered with soft expanded urethane without a separate soft cover, unlike the conventional construction. As a result, the shins of the passenger 8 seated on the seat 2 in the rear can be prevented from coming into direct contact with the hard metallic frame, so that the contact to the shins of the passenger 8 seated on the seat 2 in the rear can be moderated.

When the seat trim 11 is put on the surface of the cushion pad 10, it is necessary to pull end portions of the seat trim 11 to prevent the formation of wrinkles and the like and to fix the end portions of the seat trim 11 to the lower face of the cushion frame 9 by applying tension to some degree. At this time, since the cushion pad 10 is compressed by the seat trim 11, the shape of the seat cushion 3 is liable to be deformed, and deformed shape is liable to occur especially at the corners of the cushion pad 10.

According to the construction of the seat cushion 3 in accordance with this embodiment, the rear end 14*a* of the side frame 14 projects outward and rearward from the recess 15*a* in the rear frame 15, and is not covered with the extension 10*a* of the cushion pad 10. Therefore, at the time of covering, the corner portion of the cushion pad 10 is not deformed even if tension is applied to the seat trim 11, so that the shape of the corner portion of the cushion pad 10 can be maintained. As a result, the deformation at the rear end corner of the seat cushion 3 can be prevented, so that the dimensional accuracy can be maintained easily and surely. The rear end 14*a* of the side frame 14 is located within the seat trim 11 without being covered with the cushion pad 10. However, since the slide rail 6 is disposed under the rear end 14*a* as shown in FIG. 1, the foot of the passenger 8 does not get in a space just under the rear end 14*a*. Therefore, there is no fear that the shin of the passenger 8 comes into contact with the rear end 14*a* of the side frame 14, which is made of a metallic material.

Also, according to the construction of the seat cushion 3 in accordance with this embodiment, the inclined face 15*b* spreading on the outside gradually toward the rear is interposed between the recess 15*a* in the rear frame 15 of the cushion frame 9 and the rear end 14*a* of the side frame 14. Therefore, the concentration of stresses can be prevented, so that an impact load applied from the side can be distributed gradually to the side frame 14. By contrast, for example, if the recess 15*a* in the rear frame 15 and the rear end 14*a* of the side frame 14 are connected at right angles, there is a fear that stresses concentrate at the connected portion of the recess 15*a* and the rear end 14*a* when an impact load is applied to the seat 1 in the front from the side.

The above is a description of one embodiment of the present invention. The present invention is not limited to the above-described embodiment, and various modifications and changes can be made based on the technical concept of the present invention.

Figure 7:
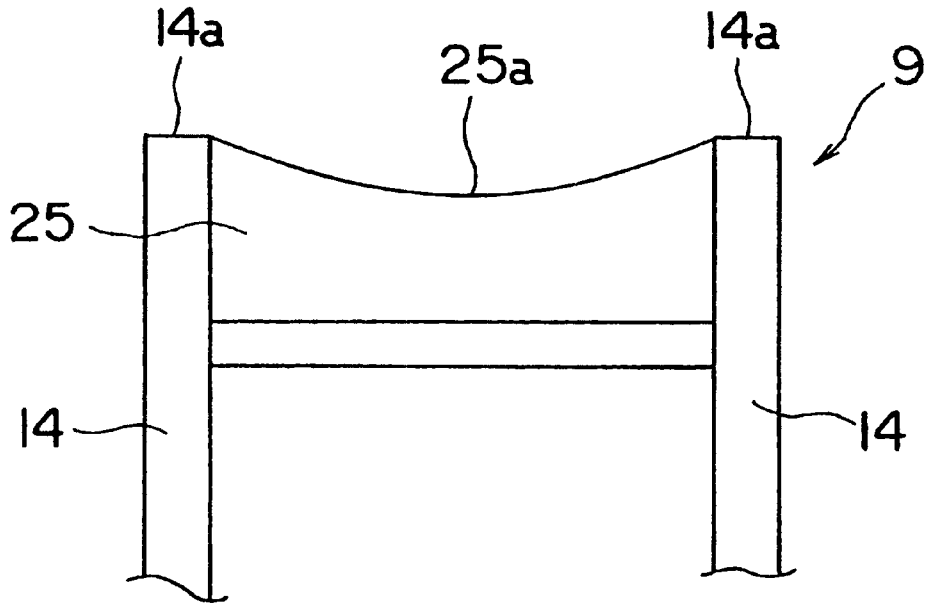
FIG. 7 is a plan view of a cushion frame viewed in the direction of the arrow W of FIG. 3, to which a construction of a seat cushion in accordance with a modification of embodiment of the present invention is applied.

For example, in the above-described embodiment, the recess 15*a* in the rear frame 15 and the rear end 14*a* of the side frame 14, the rear frame 15 and the side frame 14 constituting the cushion frame 9, are connected by the inclined face 15*b* spreading on the outside gradually toward the rear. However, as shown in FIG. 7, a recess 25*a* in a rear frame 25 constituting the cushion frame 9 may be formed by a curved face spreading on the outside gradually toward the rear so that each end of the curved face may be connected to the rear end 14*a* of the side frame 14. According to this construction, an impact load applied from the side of the seat cushion 3 is distributed to the side frame 14 more effectively, by which the concentration of stresses can be prevented. Also, the seat 2 in the rear may be a rear seat or a middle seat depending on the number of arranged automobile seats.

What is claimed is:

1. A seat cushion construction comprising:

a cushion frame comprising front, rear and side frames assembled to form a generally rectangular shape; and a cushion pad covered with a skin and mounted on said cushion frame, wherein said rear frame is provided with a recess extending inwardly toward said front frame and further wherein said cushion pad comprises an extension extending downward integrally formed at a rear end portion thereof and further wherein said extension fits in the recess of said cushion frame to cover a rear end of said cushion frame, wherein said side frames of the cushion frame each comprise projections extending outward and rearward from said recess which are not covered with said cushion pad, wherein the recess in said rear frame of the cushion frame and said projections extending out from said side frames are connected by an inclined face spreading on the outside gradually toward the rear.

2. A seat cushion construction comprising:

a cushion frame comprising front rear and side frames assembled to form a generally rectangular shape; and a cushion pad covered with a skin and mounted on said cushion frame, wherein said rear frame is provided with a recess extending inwardly toward said front frame and further wherein said cushion pad comprises an extension extending downward integrally formed at a rear end portion thereof and further wherein said extension fits in the recess of said cushion frame to cover a rear end of said cushion frame, wherein said side frames of the cushion frame each comprise projections extending outward and rearward from said recess which are not covered with said cushion pad, wherein the recess in said rear frame of the cushion frame comprises a curved face spreading on the outside gradually toward the rear so that each end of said curved face is connected to each of said projections extending out from said side frames.

* * * * *